US009734742B2

(12) United States Patent
Yin et al.

(10) Patent No.: US 9,734,742 B2
(45) Date of Patent: Aug. 15, 2017

(54) DEEP VIEWER

(71) Applicants: Lo I Yin, Silver Spring, MD (US); Way Yin, Bellingham, WA (US); Hwei Yin, Ft. Collins, CO (US)

(72) Inventors: Lo I Yin, Silver Spring, MD (US); Way Yin, Bellingham, WA (US); Hwei Yin, Ft. Collins, CO (US)

(73) Assignee: DEEP VIEW, LLC, Bellingham, WA (US)

( * ) Notice: Subject to any disclaimer, the term of this patent is extended or adjusted under 35 U.S.C. 154(b) by 69 days.

(21) Appl. No.: 14/687,785

(22) Filed: Apr. 15, 2015

(65) Prior Publication Data

US 2016/0307475 A1 Oct. 20, 2016

(51) Int. Cl.
*G09F 19/02* (2006.01)
*G09F 19/14* (2006.01)

(52) U.S. Cl.
CPC ..... *G09F 19/14* (2013.01); *G09F 19/02* (2013.01)

(58) Field of Classification Search
CPC ..... G09F 19/14; G09F 19/12; G09F 7/20; G09F 7/22
USPC ..... 40/492, 493, 495, 433, 435, 615, 743, 40/800, 474, 446
See application file for complete search history.

(56) References Cited

U.S. PATENT DOCUMENTS

| | | | | |
|---|---|---|---|---|
| 2,151,055 | A * | 3/1939 | Stark | B44F 7/00 273/157 A |
| 4,161,831 | A | 7/1979 | Restle | |
| 4,233,767 | A | 11/1980 | Hryhorczuk | |
| 5,309,657 | A * | 5/1994 | Spencer | A47F 5/02 40/473 |
| 5,803,564 | A | 9/1998 | Bruinsma et al. | |
| 6,812,907 | B1 | 11/2004 | Gennetten et al. | |
| 7,199,793 | B2 | 4/2007 | Oh et al. | |
| 7,778,491 | B2 | 8/2010 | Steedly et al. | |
| 8,712,137 | B2 | 4/2014 | Wollenweber | |
| 8,893,413 | B1 | 11/2014 | Shepard | |

* cited by examiner

*Primary Examiner* — Cassandra Davis
(74) *Attorney, Agent, or Firm* — Ming Chow; Sinorica, LLC

(57) ABSTRACT

The present invention relates to a method of displaying an artwork, comprising the steps of: i) providing an artwork comprising an image, real or virtual; ii) dividing and separating the image into a plurality of segments; iii) arranging the plurality of segments in parallel planes, while keeping the segments oriented in their respective original positions within the image; iv) viewing the plurality of segments from one or more viewpoints; and v) changing the viewpoint to a predetermined angle such that the segments reveal a complete image with a surprising perception of depth.

4 Claims, 14 Drawing Sheets

DEEP VIEWER

FIELD OF THE INVENTION

The present invention generally relates to display of artwork including pictures, text, figures and designs, and more specifically relates to methods of displaying artwork by segmentation and arrangement of a visual representation of an artwork to achieve surprise and a perception of depth.

BACKGROUND OF THE INVENTION

Display of an artwork is a constantly evolving process which is greatly influenced by the artist's creativity, imagination, presenting medium, and the technology available. Different modes for display of indicia and/or images have conventionally been used. For example, certain art forms, created or reproduced on a medium such as planar devices display different images when viewed from different angles. In another example, the use of venetian blind type of devices for alternately hiding or revealing a picture is well known in the field of children's books or amusement devices.

Different types of optical illusions have been employed by a variety of artists including painters, sculptors and photographers for creating a mystery or surprise effect, especially to the viewers or audience. Changing the depth of view constitutes a form of optical illusion which reveals a complete image or structure with a pleasant and surprising perception of depth, when the viewing angle or viewing perspective of the observer is changed from one to another.

SUMMARY OF THE INVENTION

The present invention relates to a method of displaying an artwork, comprising the steps of: i) providing an artwork comprising an image, real or virtual; ii) dividing and separating the image into a plurality of segments; iii) arranging, such that the segments are oriented with respect to their original positions within the image; iv) viewing the plurality of segments from a viewpoint; and v) changing the viewpoint to a predetermined angle where it reveals the complete image with a pleasant and surprising perception of depth.

In an embodiment, the present invention relates to a deep viewer comprising an image reproduced on one or more faces of a substrate material and the image bearing substrate material is segmented and arranged in parallel planes. The plurality of segments in parallel planes provides no clue of the complete image when viewed from a first view point due to the disassembled view of segments. However, upon viewing from a second viewpoint, a complete image will be revealed with an additional unexpected sensation of depth. The substrate material bearing the artwork may comprise a two-dimensional or three-dimensional object.

DETAILED DESCRIPTION OF THE INVENTION

The following detailed description of the preferred embodiments presents a description of specific embodiments to assist in understanding the claims. However, the present invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be evident to one of ordinary skill in the art that the present invention may be practiced without these specific details.

The present invention relates to a method for displaying an artwork, comprising the steps of: i) providing an artwork comprising an image, real or virtual; ii) dividing and separating the image into a plurality of segments; iii) arranging the plurality of segments in parallel planes, such that the segments are oriented with respect to their original positions within the image; iv) viewing the plurality of segments from a viewpoint; and v) changing the viewpoint to a predetermined angle where it reveals a complete image with a surprising sensation of depth.

In an embodiment, the present invention relates to a deep viewer comprising an image reproduced on one or more faces of a substrate material and the image bearing substrate material is segmented and arranged in parallel planes. The plurality of segments in parallel planes provides no clue of the actual image when viewed from a first view point due to the disassembled view of segments. However, upon viewing from a second viewpoint, a complete image will be revealed with an additional unexpected sensation of depth. The substrate material bearing the artwork may comprise a two-dimensional or three-dimensional object.

Figure 1A:
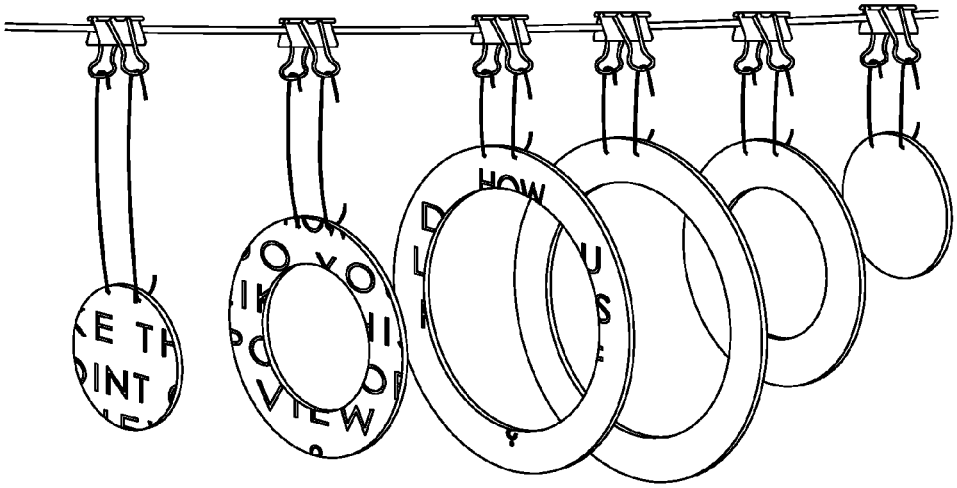
FIG. 1A is an oblique view of an artwork displayed according to a method of the present invention.

Referring to FIG. 1A, which shows an oblique view of an artwork displayed according to a method of the present invention. The artwork comprises an image comprising a picture or text reproduced on a substrate material such as a cardboard, plastic, ceramic, metal and the like. The image bearing substrate is cut into, or produced as, a plurality of segments and arranged in separate planes parallel to each other. The segments can be arranged by means of suspending support or similar structure such that the orientation of each segment with respect to the original complete image is kept intact, although in a separated position. When viewed from one or more viewpoints, for example an oblique viewpoint as shown in the FIG. 1A, the segments are visible separately with the broken image components that do not constitute a complete picture or text with meaning.

Figure 1B:
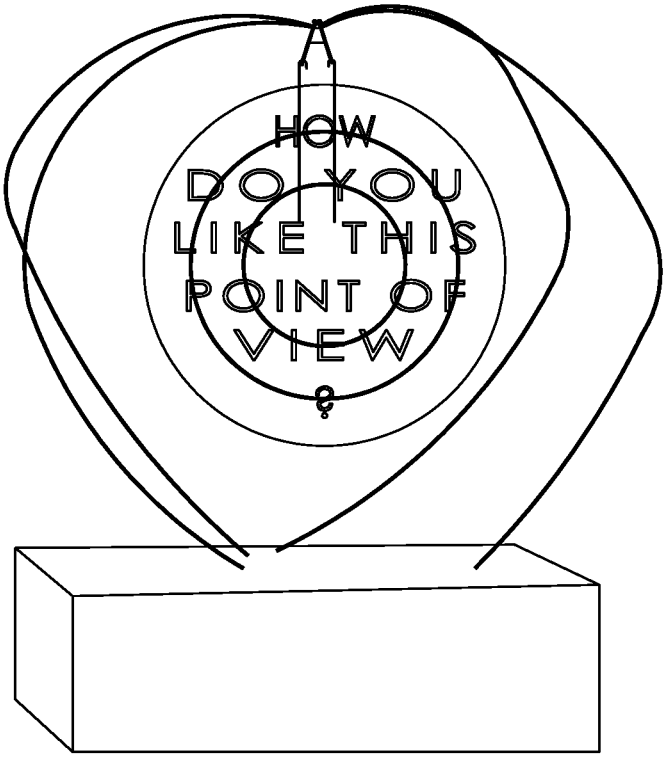
FIG. 1B is a frontal view of the artwork displayed according to the method of the present invention.

When the viewpoint or perspective of the viewer is changed to a predetermined angle, the segments begin to reveal a complete image. For example, when the viewpoint is changed from oblique view to a frontal view, the segments reveal a complete image from the frontal view as shown in FIG. 1B with a perception of depth. In an embodiment, the viewpoint or perspective is changed by movement of a rotating platform which holds the assembly comprising a plurality of image segments arranged in parallel planes, while the viewer or observer is in a stationary position. Alternatively, the viewer or observer can alter his/her viewpoint by moving around in one or more direction, for example: a viewer can initially view the artwork from one of the sides and then walk around the artwork towards the front side for viewing the ensemble of segments head-on. The artwork comprising an ensemble of segments, when viewed from lateral side shows no clue of the actual image but when viewed head-on from the front side, the segments begin to reassemble visually and reveal a complete image, thus providing a pleasant and surprising sensation of depth due to the separation of segment planes. The sensation of depth may be enhanced by the use of augmented perspectives of depth in the artwork itself.

Figure 2A:
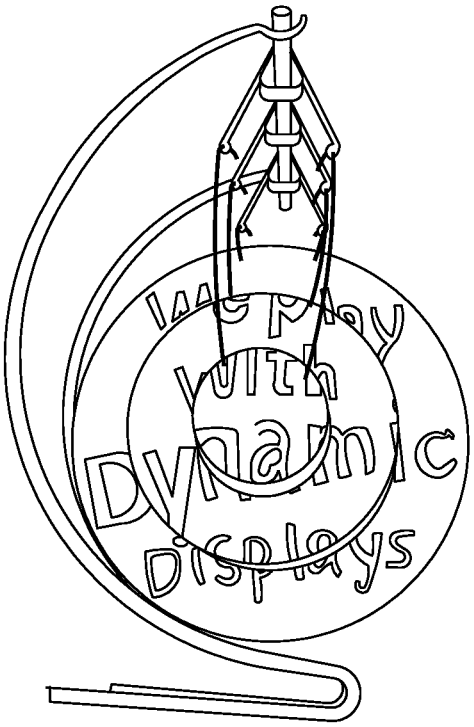
FIG. 2A is a frontal view of an artwork on ceramic tiles displayed according to a method of the present invention.
Figure 2B:
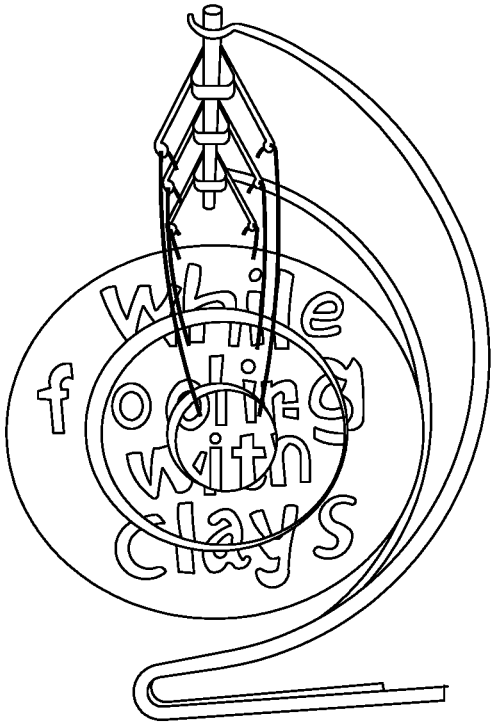
FIG. 2B is a rear view of an artwork on ceramic tiles displayed according to a method of the present invention.

In an embodiment, a two dimensional object can be used as a substrate material upon which an artwork can be reproduced or affixed. For example: a substrate material bearing two different images (first and second image) on the front face and the rear face can be segmented and arranged in separate parallel planes, so that when viewed from an oblique angle, merely segments of an image are visible to a viewer but begin to reveal a complete first image when viewed head on from the front side and a complete second image when viewed from the rear side, with a surprising sensation of depth. FIG. 2A shows a frontal view of segmented ceramic tile substrate displaying a complete first image on the front side. FIG. 2B shows a rear view of segmented ceramic tile substrate displaying a complete second image on the rear side. Concentrically arranged moving substrate segments adapted to rotate or counter-rotate at different speeds provide a depth of view of the artwork to viewers circumferentially. For example, such artworks can be displayed by suspending or erecting concentric segments bearing artwork above a booth at a trade show or science exhibition.

Figure 3A:
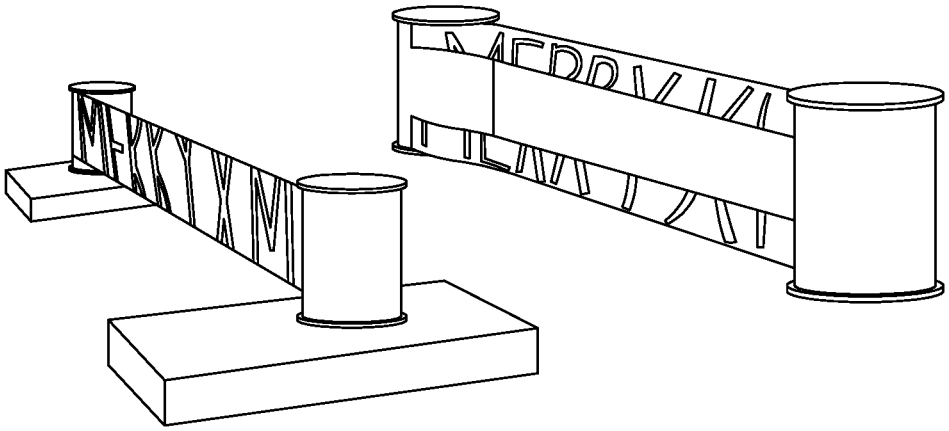
FIG. 3A is an oblique view of an artwork displayed in moving strips according to a method of the present invention.
Figure 3B:
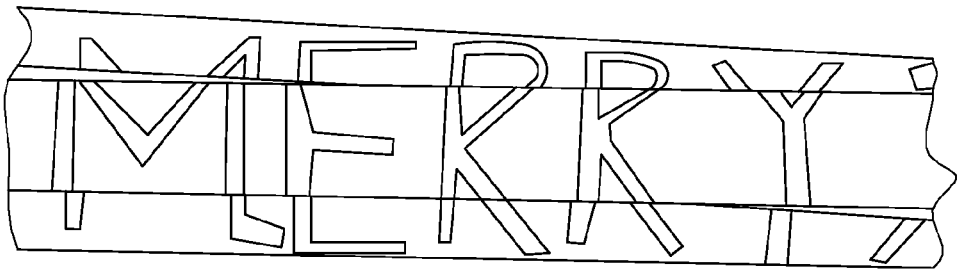
FIG. 3B is a frontal view of the artwork displayed in moving strips according to a method of the present invention.

In another embodiment, the substrate material may comprise moving strips bearing an artwork such as an image or text, the strip can be segmented and arranged in parallel planes, such that the strip segments reveal a complete image when viewed from front side. For example: the strip may comprise a text reading "MERRY X MAS", which can be cut into multiple horizontal strips and arranged in parallel planes for viewing from different perspectives. FIG. 3A shows an oblique view of a text image displayed in moving strips segmented and arranged in parallel planes. The arrangement of strip segments show an incomplete text when viewed from an oblique angle. FIG. 3B shows a frontal view of a text image displayed in moving strips segmented and arranged in parallel planes. The arrangement of strip segments begins to reveal the complete text, reading "MERRY X MAS" in this example, when viewed from the front side.

The present method of display of artwork employs the principle of depth viewing, which can be used to create and display art works including sculptures, paintings, pictures, greeting cards, patterns or abstract displays which are real or virtual, etc., with unlimited variations in number, shape and pattern of divided segments. The above method can also be used for displaying pictures or images in books, games and display of art work, models or exhibits at planetariums, museums, science exhibits, trade shows, amusement parks, marketing or advertising displays, sequential billboards, sport events displays, even complex of buildings and similar venues. In an embodiment, the substrate segments bearing the artwork can be arranged to move with respect each other in such a way so as to reveal an actual image when viewed from one or more specific viewpoints or viewing angles.

The image bearing substrate material or the parallel planes comprising the segments of image can be multi-faceted, such as a polyhedron, thus accommodating more than two images. For example, the multifaceted structures bearing image segments can be manufactured with a 3-D printer and arranged in such a way that, when these parallel segmented facets are rotated synchronously the viewer can experience depth-viewing of multiple pictures.

Figure 4A:
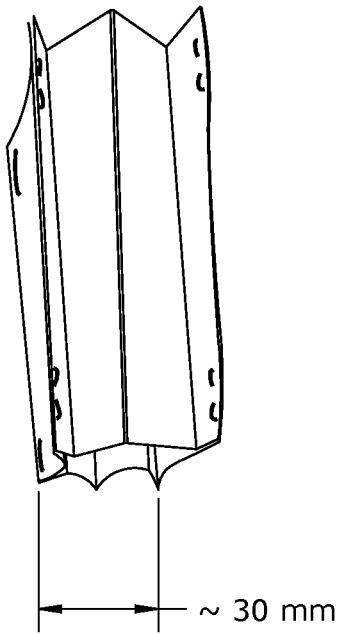
FIG. 4A is a side view of a greeting card arranged according to a method of the present invention.
Figure 4B:
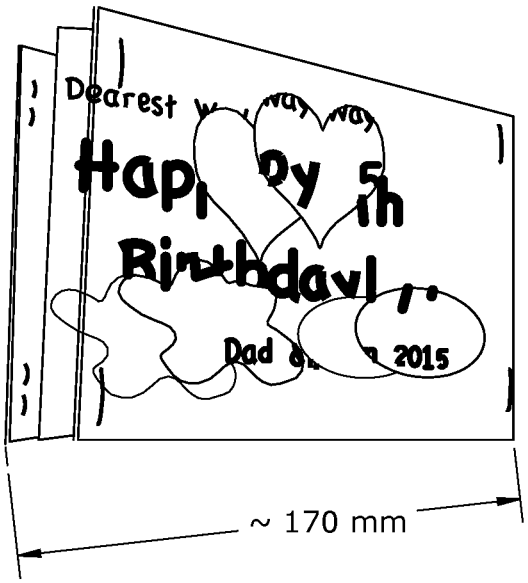
FIG. 4B is an oblique view of the greeting card arranged according to a method of the present invention.
Figure 4C:
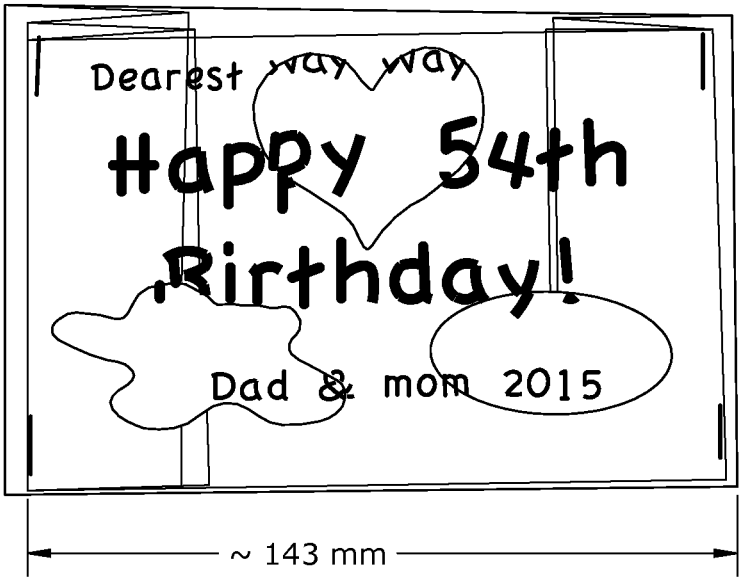
FIG. 4C is a frontal view of the greeting card arranged according to a method of the present invention.
Figure 4D:
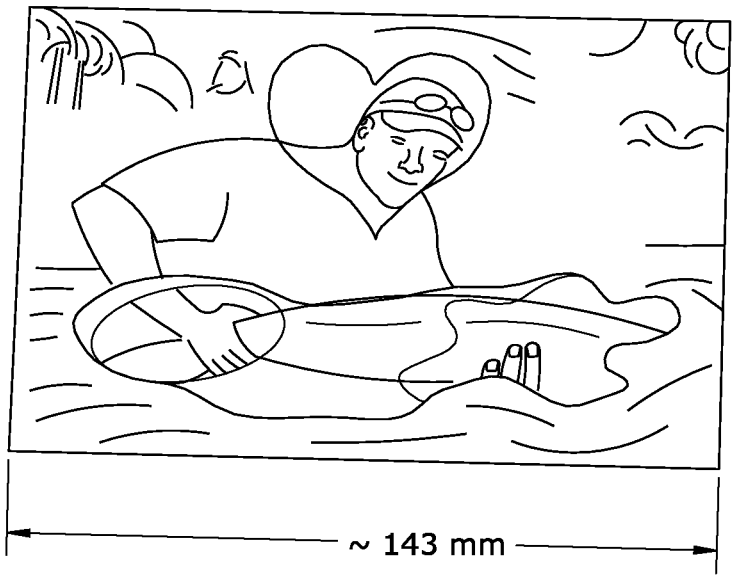
FIG. 4D is a rear view of the greeting card arranged according to a method of the present invention.

In an embodiment, greeting cards can be created and assembled according to the method of the present invention. The greeting card comprising a message, image or picture, or its combinations can be segmented and arranges in parallel planes for depth viewing. For example, images can be printed directly on, or upon removable labels affixed to, transparent plastic sheets, of greeting cards size. The labels containing the images are cut into random shapes (for example heart, oval, amoeba shaped cut outs). FIG. 4A shows a side view of the greeting card comprising a plurality of segments arranged in parallel viewing panels. FIG. 4B shows an oblique view of the greeting card comprising segments of the message distributed over different parallel panels. The card, when viewed from an oblique angle, only reveals certain parts of the message. FIG. 4C shows a frontal view of the greeting card revealing a complete message. The viewing panels are arranged in such a way so as to reveal the complete message only when viewed directly from the front side. Similarly, the rear side of the card comprises an image that is segmented and arranged in similar manner on the reverse side of the panels such that it reveals a complete image only when viewed directly from the rear side. FIG. 4D shows a rear view of the greeting card revealing a complete image or picture, thus providing a pleasant and surprising sensation of depth due to the separation of segment planes.

Figure 5A:
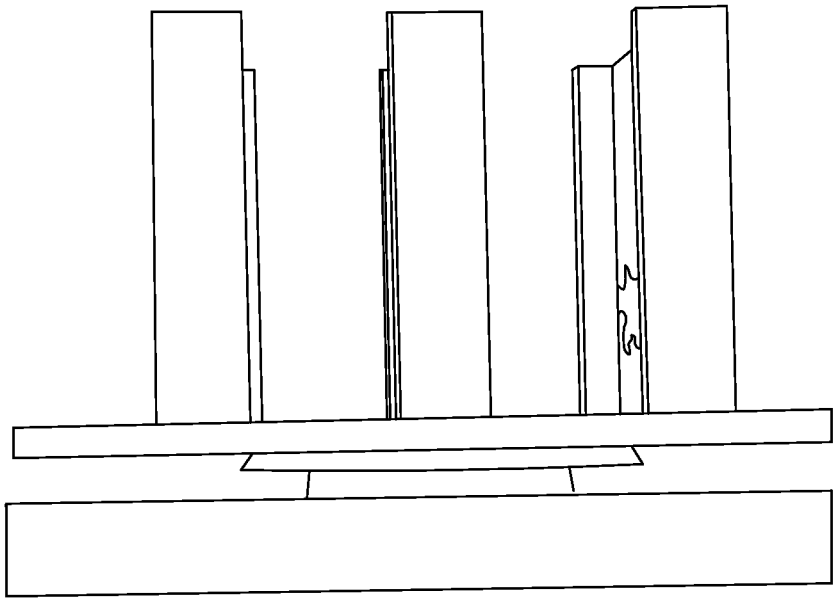
FIG. 5A is a side view of an artwork displayed according to a method of the present invention.
Figure 5B:
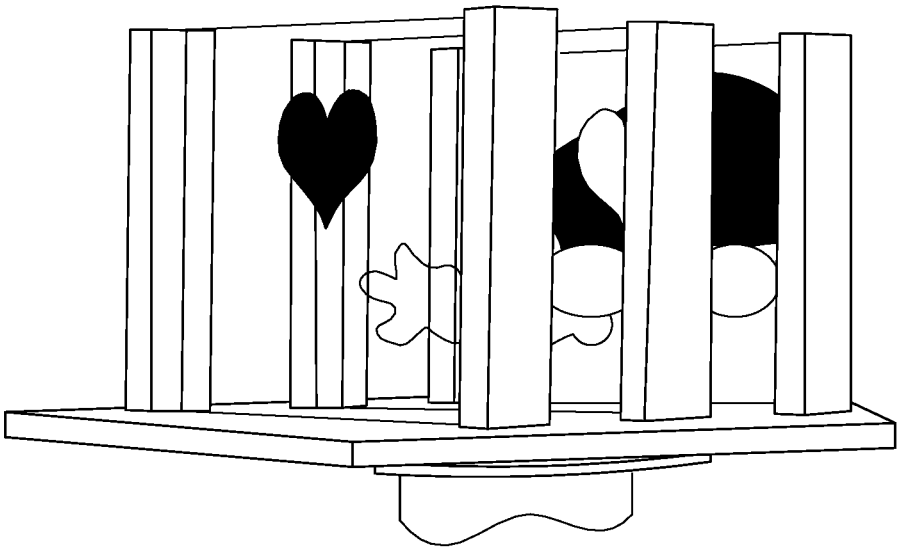
FIG. 5B is an oblique view of the artwork displayed according to the method of the present invention.
Figure 5C:
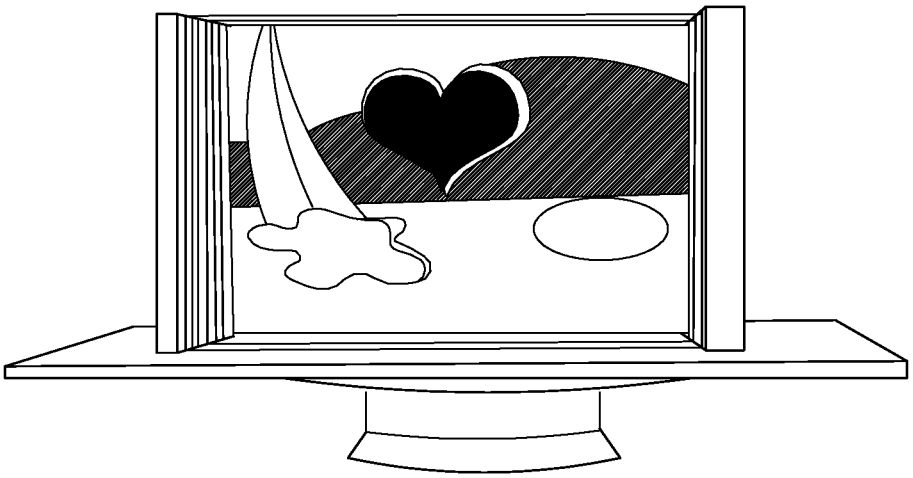
FIG. 5C is a frontal view of the artwork displayed according to the method of the present invention.
Figure 5D:
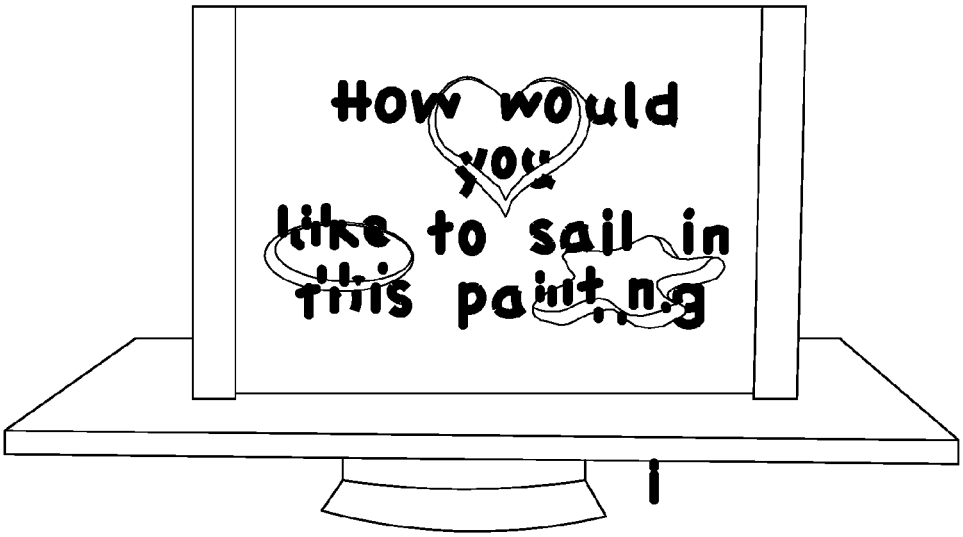
FIG. 5D is a rear view showing the reverse side of the artwork displayed according to the method of the present invention.

In an embodiment, the present invention relates to a method of displaying an artwork using transparent material such as plexiglass substrate material. The two vertical edges of each plexiglass panel are inserted into respective slots on two wooden holders so that the panels are held upright for viewing. In an example, an image can be printed on a removable label, segmented into random shapes (such as cut-outs of different shapes), affixed to the transparent plexiglass substrates and arranged in parallel planes. These panels are placed above a motor-driven rotating platform. The artwork display can be viewed from different perspectives due to the rotational movement of the platform. For example, FIG. 5A shows a side view of the artwork arrangement, wherein only the wooden holders are visible. FIG. 5B shows an oblique view of the artwork arrangement, where the heart-shaped cut-out affixed to one of the panels is clearly visible. FIG. 5C shows a frontal view of the artwork arrangement revealing a complete painting. The frontal view renders the three cut-outs (heart shaped, oval shaped, amoeba shaped) from different planes to fit into their respective positions and reveal the complete painting. Similarly, the rear side of the plexiglass substrate can be affixed with a removable label comprising a text message. The labels are similarly segmented and arranged in parallel planes so that they reveal a complete message or text only when viewed directly from the rear side. FIG. 5D shows a rear view of the artwork arrangement revealing a complete message.

Although the above embodiments in FIGS. 1 and 2 disclose segments that are axially symmetric, in other embodiments the segments can also be axially asymmetric as in FIGS. 4 and 5. In addition to the above embodiments, three-dimensional objects can also be used for bearing one or more segmented images reproduced or affixed on different dimensions or faces of the object, such that the segments reveal a different picture when viewed from each dimension or face.

In another embodiment, the artwork can be reproduced or projected on faces of a plurality of buildings within a building complex, such that the whole building complex surprisingly reveals a complete unexpected image when viewed from one or more specific locales. For example, an artwork comprising a painting can be recreated or projected in segments on the faces of multiple buildings within a complex, such that the building complex surprisingly reveals a complete painting when viewed from a specific locale.

In another embodiment, the artwork can be reproduced or projected on faces of a plurality of billboards such that the artwork is only partially viewable or appears to be incomplete until the viewer reaches a certain viewing angle or position, whereby a complete unexpected image is revealed. In an exemplary embodiment, highway billboards or billboards adjacent to train tracks, may be arranged such that the artwork is revealed only when viewed from a flat, straight section, but appears incomplete when viewed from a hill or curve approaching the billboard. In another example, the billboard can be arranged in such a way to reveal the artwork or advertisement only when viewed from the front or from the sides.

The present invention has been described with several preferred embodiments thereof and it is understood that many changes and modifications to the described embodiments can be carried out, without departing from the scope and the spirit of the invention that is intended to be limited only by the appended claims.

The invention claimed is:

1. A method of displaying an artwork comprising:

providing an artwork comprising an image, real or virtual;

dividing and separating the image into a plurality of segments;

arranging the plurality of segments in parallel planes, while keeping the segments oriented in their respective original positions within the image;

viewing one or more of the plurality of segments from different viewpoints;

changing the viewpoint to a predetermined angle such that the segments reveal a complete image with a perception of depth;

providing a plurality of two-dimensional plexiglass panels;

parallelizing the plurality of two-dimensional plexiglass panels;

reproducing the plurality of segments on the plurality of two-dimensional plexiglass panels;

providing a plurality of wooden holders;

the wooden holder comprising a slot;

the two-dimensional plexiglass panel comprising a vertical edge;

inserting the vertical edge into the slot;

the two-dimensional plexiglass panel comprising a front surface;

the plurality of segments comprising a plurality of figures, drawings, designs, pictures, photos or paintings;

reproducing the plurality of figures, drawings, designs, pictures, photos or paintings on the plurality of front surfaces;

the two-dimensional plexiglass panel comprising a rear surface;

the plurality of segments comprising a plurality of texts or symbols;

reproducing the plurality of texts or symbols on the plurality of rear surfaces;

providing a rotating platform; and mounting the plurality of wooden holders on the rotating platform.

2. The method of claim 1 comprising the wooden holder being adapted to be hand-held, anchored or suspended on supporting structures.

3. The method of claim 1 comprising changing the viewpoint via movement of the rotating platform with respect to a viewer.

4. The method of claim 1 comprising changing the viewpoint via movement of a viewer with respect to the plurality of segments.

* * * * *